United States Patent [19]

Callies

[11] 4,455,777

[45] Jun. 26, 1984

[54] CALIBER-REDUCING KIT FOR A REVOLVER

[76] Inventor: David G. Callies, 3400 Goodfellow Ave., St. Louis, Mo. 63120

[21] Appl. No.: 395,485

[22] Filed: Jul. 6, 1982

[51] Int. Cl.[3] ..... F41C 21/10; F41C 1/00

[52] U.S. Cl. ..... 42/59; 42/77

[58] Field of Search ..... 42/59, 61, 77

[56] References Cited

U.S. PATENT DOCUMENTS

| | | | |
|---|---|---|---|
| 37,961 | 3/1863 | Hall | 42/61 |
| 109,914 | 12/1870 | Linberg et al. | 42/61 |
| 640,070 | 12/1899 | Aeschbacher | 42/77 |
| 969,011 | 8/1910 | Vedder | 42/59 |
| 2,238,587 | 4/1941 | Gaidos | 42/59 |
| 2,976,638 | 3/1961 | Owens | 42/59 |
| 4,304,061 | 12/1981 | Brouthers | 42/59 |

*Primary Examiner*—Charles T. Jordan

*Attorney, Agent, or Firm*—Cohn, Powell & Hind

[57] ABSTRACT

A caliber-reducing adaptor kit for a revolver having an original revolver barrel, and a cylinder with a chamber having a powder-receiving compartment at one end. A substitute barrel, having a reduced caliber bore, is received in and is detachably mounted to the original revolver barrel. A cylinder insert is removably received in the cylinder chamber between the substitute barrel and the powder-receiving compartment, the insert having a caliber bore substantially the caliber of the substitute barrel. The cylinder insert includes a plunger having a head at one end engageable with an end portion of the substitute barrel, and having a shank portion, the bore being provided in the plunger. A sleeve is slidably mounted on the shank portion of the plunger and is engageable with the cylinder adjacent the powder-receiving compartment. The sleeve is retained captive on the plunger shank portion, and a resilient spring is located between the sleeve and plunger, providing relative movement of the sleeve and plunger under resilient loading. The substitute barrel includes an elongate tube extending internally of and spaced from the original revolver barrel, the tube having opposed threaded ends. A tubular fitting is threadedly connected to each threaded end, the fittings adjustably engaging and clamping the tube to opposite ends of the original revolver barrel.

14 Claims, 3 Drawing Figures

CALIBER-REDUCING KIT FOR A REVOLVER

BACKGROUND OF THE INVENTION

This invention relates generally to improvements in a caliber-reducing adaptor kit for a revolver, and more particularly to a kit for a revolver having an original revolver barrel, and a cylinder with a chamber having a powder-receiving compartment at one end.

Various attempts have been made to convert a revolver having a particular bore caliber to a revolver capable of firing a shell or bullet of a different caliber. In these heretofore conventional conversions, the cylinders having different cartridge chambers have been substituted for the original cylinders, and barrels having different caliber bores, conforming with the substitute cartridge chambers, have been substituted for the original barrels.

In still other conventional conversions, inserts have been provided for the chambers of the cylinders to receive cartridges of a different caliber. These types of conversions require a cooperative insert portion provided with a firing pin plunger and shell extractor.

SUMMARY OF THE INVENTION

The present caliber-reducing adaptor kit is for a revolver having an original revolver barrel, and a cylinder with a chamber having a powder-receiving compartment at one end. The kit includes a substitute barrel having a reduced caliber bore received in and detachably mounted to the original revolver barrel, and includes a cylinder insert removably received in the cylinder chamber between the substitute barrel and the powder-receiving compartment, the insert having a caliber bore substantially the caliber of the substitute barrel.

In one aspect of the adaptor kit, the cylinder insert includes a reduced bore portion for engaging and positioning a shot placed in the insert bore.

In another aspect of the adaptor kit, the cylinder insert includes a plunger having a head at one end adjacent the substitute barrel, and having a shank portion, the bore being provided in the plunger. A sleeve is slidably mounted on the shank portion of the plunger, and is located adjacent the powder-receiving compartment.

In still another aspect of the adaptor kit, the substitute barrel includes an end portion adjacent the cylinder, and the cylinder insert is slidably mounted in the cylinder chamber, the cylinder insert including a head at one end engageable with the end portion of the substitute barrel.

In an aspect of the adaptor kit, the cylinder insert includes a plunger having a head at one end engageable with the end portion of the substitute barrel adjacent the cylinder, and having a shank portion, the bore being provided in the plunger. A sleeve is slidably mounted on the shank portion of the plunger, and is engageable with the cylinder adjacent the powder-receiving compartment.

In another aspect of the adaptor kit, the cylinder insert includes means retaining the sleeve captive on the plunger shank portion, and a resilient means between the sleeve and plunger providing relative movement of the sleeve and plunger under resilient loading. More particularly, the resilient means is located about the plunger shank portion and is located between the plunger head and sleeve.

In another aspect of the adaptor kit, the substitute barrel includes an elongate tube extending internally of and spaced from the original revolver barrel, the tube having opposed threaded ends. A tubular fitting is threadedly connected to each threaded tube end, the fittings adjustably engaging and clamping the tube to opposite ends of the original revolver barrel.

In still another aspect of the adaptor kit, the cylinder insert includes a resilient means tending to urge the head outwardly of the cylinder chamber, the head being resiliently depressable inwardly of the cylinder chamber upon alignment of the head and substitute barrel, and resiliently extendable to snap into the barrel fitting adjacent the cylinder.

DESCRIPTION OF THE PREFERRED EMBODIMENT

Figure 1:
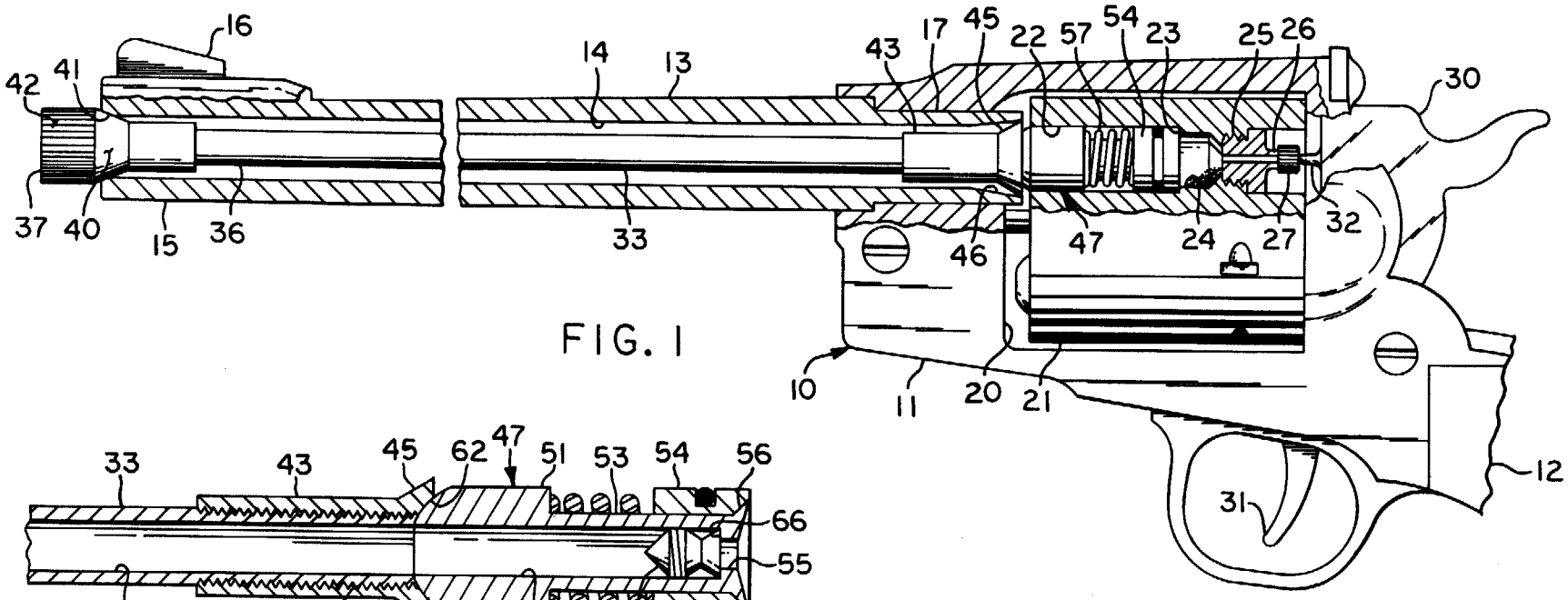
FIG. 1 is a fragmentary side elevational view of the revolver, partially in cross section, to show the component parts and assembly of the component parts of the adaptor kit.

Referring now by characters of reference to the drawings, and first to FIG. 1, it will be understood that the revolver generally indicated by 10 includes a frame 11 and a butt 12. Affixed to and carried by the front end of the frame 11 is an original barrel 13 that has a particular predetermined caliber bore 14, which in the embodiment disclosed is a 0.45 caliber bore. The outermost end 15 of the original barrel 13 is provided with a conventional front sight 16. The innermost end 17 of the original barrel 13 communicates with a frame opening 20 that is adapted to receive a cylinder 21.

As is conventional, the cylinder 21 is located in the frame opening 20, and is rotatively mounted on the revolver frame 11. The cylinder 21 is provided with a plurality of, and in this particular instance a total of six, cylinder chambers 22 that are adapted to align selectively with the original revolver barrel bore 14 upon rotation of the cylinder 21. Each of the original cylinder chambers 22 is a caliber bore that conforms with the caliber bore 14 of the original revolver barrel 13 so as to receive as in this instance, a 0.45 caliber shot. Each cylinder chamber 22 includes a shoulder 23 that is adapted to engage and position the 0.45 caliber shot in the cylinder chamber 22, and to separate that portion of the cylinder chamber 22 from a powder-receiving compartment 24 located just rearwardly of the shot.

Threadedly attached to the cylinder 21 to close the rear end of each powder-receiving compartment 24, is a chamber fitting 25. Each fitting 25 includes a rearwardly extending tube portion 26, and a small bore therethrough that communicates with the rear end of the powder-receiving compartment 24. The tube portion 26 of the fitting 25 is adapted to receive and retain a firing cap 27.

As is conventional, the revolver 10 includes a hammer 30 that can be actuated by a trigger 31 so that the hammer firing pin 32 strikes the firing cap 27 with sufficient force to ignite and explode the powder located within the powder-receiving compartment 24.

To load the revolver 10 in the usual manner to fire 0.45 caliber ball shot, a predetermined load of powder is inserted into and through the front open end of each cylinder chamber 22, and is tamped into the powder-receiving compartment 24. A 0.45 caliber ball shot is then inserted into the chamber 22 and is held in position against the shoulder 23 and adjacent to the powder-receiving compartment 24, by a suitable wad if desired. A firing cap 27 is then located over each tube portion 26 of the associated cylinder chamber fitting 25. The revolver 10 is now loaded for firing.

To fire the revolver 10, the hammer 30 is cocked and the trigger 31 is pulled to release the hammer 30 so that the hammer pin 32 strikes the firing cap 27, and thereby ignites and explodes the powder in the compartment 24, and thereby expels the ball shot from the cylinder chamber 22 and through the original barrel bore 14.

The present caliber-reducer adaptor kit includes a substitute barrel 33 having a substantially reduced caliber bore 34, as for example a 0.170 caliber, adapted to receive a shot or pellet 35 of the same caliber.

The outermost end 36 about the substitute barrel 33 is threaded (not shown) to threadedly receive a tubular barrel fitting 37. This tubular barrel fitting 37 includes a tapered portion 40 that engages compatible tapered surfaces 41 at the end 15 of the original barrel 13 and forming the end of the original barrel bore 14, the engagement of the mating tapered fitting portion 40 and barrel surfaces 41 tending to center the substitute barrel 33 within the bore 14 of the original barrel 13. The tubular barrel fitting 37 also includes a cylindrical portion 42 located outwardly of the original barrel 14 so as to facilitate threaded adjustment of the fitting 37 on the substitute barrel end 36, for reasons which will be later explained in detail.

Figure 2:
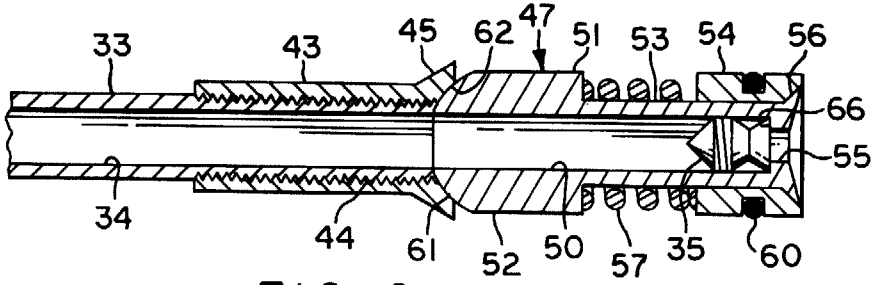
FIG. 2 is a fragmentary, enlarged cross-sectional view of the substitute barrel and the cylinder insert.

A similar tubular barrel fitting 43 is threadedly attached to the opposite inner end 44 of the substitute barrel 33, as is best shown in FIG. 2. This tubular fitting 43 is provided with a flared end portion 45 that is adapted to engage the inner surfaces defining the slightly enlarged bore end of the original barrel bore 14 adjacent the cylinder 21. This tubular fitting 43 cooperates with the other tubular fitting 37 to center the substitute barrel 33 within the original barrel 13.

To attach the substitute barrel 33, the cylinder 21 is removed so that when the substitute barrel 33 is inserted into and through the original barrel 13, the tubular fittings 37 and 43 can be threadedly attached to the ends 36 and 44 respectively of the substitute barrel 33. First, the tubular fitting 43 is threaded into place on the substitute barrel 33, and its flared end portion 45 is pressed inwardly against the bore surfaces 46. Then, the opposite tubular fitting 37 is threadedly tightened, so that its tapered portion 40 tightly engages the mating tapered surfaces 41 of the original barrel bore 14. The substitute barrel 33 is now secured in placed, and is substantially centered within the original barrel bore 14.

The caliber-reducing adaptor kit also includes a cylinder insert, referred to generally by 47 and best illustrated in FIG. 2. A cylinder insert 47 is provided for each of the cylinder chambers 22. The cylinder insert 47 is removably received in the cylinder chamber 22, and located between the substitute barrel 33 and the powder-receiving compartment 24. It will be understood that the cylinder insert 47 has a caliber bore 50 that conforms substantially to the caliber of the substitute barrel 33.

More particularly, the cylinder insert 47 includes a plunger 51 having a head 52 at one end adjacent the substitute barrel 33, and includes an elongate shank portion 53. The bore 50 is provided in the plunger 51. Slidably mounted on the shank portion 53, is a sleeve 54 that is located adjacent the powder-receiving compartment 24 when the cylinder insert 47 is disposed within the cylinder chamber 22.

As is best shown in FIG. 2, the plunger shank portion 53 includes a reduced bore portion 55 located adjacent to and communicating with the powder-receiving compartment 24, the plunger bore 50 and the reduced bore portion 55 providing a shoulder 56 therebetween for engaging and positioning a shot or pellet 35 of reduced caliber.

Further, the inner end of the plunger shank portion 53 is provided with an outwardly flared end portion 56 that engages and retains the sleeve 54 on the shank portion 53.

Disposed about the plunger shank portion 53, and located between and engaging the plunger head 52, and the slidably mounted sleeve 54, is a compression spring 57, constituting a resilient means. The compression spring 57 tends to hold the slidably mounted sleeve 54 against its retaining flared end portion 56 of the plunger shank portion 53, and yet permits relative movement of the plunger head 52 toward the sleeve 54 against the spring loading under circumstances which will be later described.

To provide a seal between the cylinder insert 47 and the cylinder chamber 22 when the insert 47 is positioned in place, an O-ring 60, constituting a sealing means, is carried by the sleeve 54 and effectively engages the cylindrical wall defining the chamber cylinder 22.

It will also be understood that the plunger head 52 is provided with a substantially tapered front surface 61 that selectively engages a conforming, substantially tapered inner surface 62 formed in the flared outer end 45 of the tubular fitting 43. This interfitting engagement of the plunger head 52 and the flared fitting end 45 effectively positions the front end of the cylinder insert 47, and accurately aligns the plunger bore 50 with the substitute barrel bore 34. Moreover, it will be understood that when the cylinder 21 is rotated to align the particular cylinder insert 47 with the substitute barrel 33, the engagement of the tapered end surface 61 of the plunger head 52 with the fitting 43 causes the plunger head 51 to be resiliently depressable inwardly of the cylinder chamber 22 against the loading of compression spring 57 until the plunger head 52 clears the tubular fitting 43. At which time, the resilient loading of the compression spring 57 causes the plunger head 52 to resiliently extend and snap into the tubular fitting 43 with the tapered plunger head surface 61 effectively engaging the mating tapered surface 62 of the tubular fitting 43 to align the cylinder insert bore 50 and substitute barrel bore 34.

To convert the revolver, a cylinder insert 47 is placed into each of the chamber cylinders 22, as is best shown in FIG. 1, with the end of the sleeve 54 abutting the shoulder 23 provided between the cylinder 22 and the powder-receiving compartment 24. The O-ring 60 provides an effective seal between the cylinder insert 47 and the walls of the cylinder chamber 22. The outer diameter of the plunger head 52 closely conforms with the diameter of the cylinder chamber 22 also.

Figure 3:
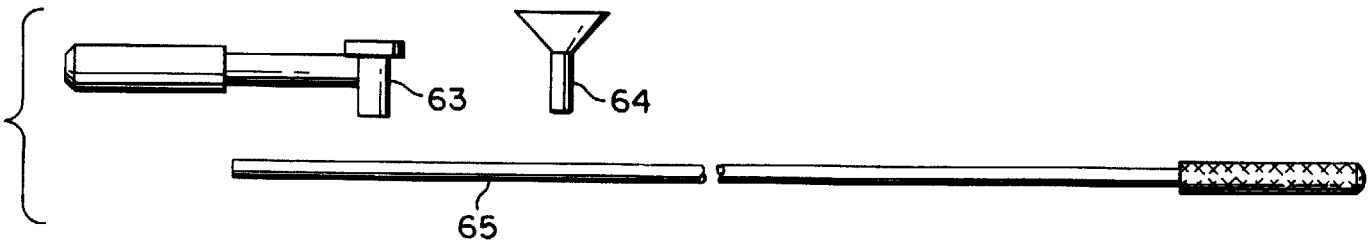
FIG. 3 illustrates accessories of the adaptor kit such as the powder-measuring device, funnel and tamping rod.

To load the converted revolver, a measured amount of powder, as determined by the size of a measuring cup 63 (FIG. 3) is poured through a funnel 64 and into the open end of the plunger bore 50. The powder then falls through the reduced bore portion 55 and into the powder-receiving compartment 24. If necessary, the powder can be tamped through the reduced bore opening 55 by the tamping rod 65. Then, a shot or pellet 35 of the appropriate reduced caliber is inserted into the open plunger bore 50, and is positioned against a shoulder 66 provided between the plunger bore 50 and the reduced bore portion 55, and immediately adjacent the powder-receiving compartment 25. The pellet 35 can be retained in place by a suitable wad if desired that is tamped in place by the rod 65.

Then, as is usual, a firing cap 27 is disposed over the tube portion 26 of each chamber fitting 25.

As the first loaded chamber insert 47 is moved into alignment with the substitute barrel 33, the plunger head 52 engages the inner end 17 of the original barrel 13 or the flared end portion 45 of the tubular fitting 43 so as to depress the plunger head 52 inwardly of the cylinder chamber 22 in a direction toward the sleeve 24 against the loading of compression spring 57, so that when the plunger bore 50 and the substitute barrel bore 34 are accurately aligned, the plunger head 52 will be resiliently extendable to snap into place with its tapered front surface 61 engaging the mating tapered surface 62 of the tubular fitting 43.

Upon cocking the hammer 30, and releasing the hammer 30 by pulling the trigger 31, the firing pin 32 will strike the firing cap 27, and thereby ignite and explode the powder in the chamber 24, effectively propelling the pellet 35 from the plunger bore 50 and substitute barrel bore 34. After firing the pellet 35, the cylinder 21 is then rotated to bring the next adjacent cylinder insert 47 into alignment with the substitute barrel 34 in the manner previously described.

I claim as my invention:

1. A caliber-reducing adaptor kit for a revolver having an original revolver barrel, and a cylinder with a chamber having a powder-receiving compartment at one end, comprising:
   (a) a substitute barrel having a reduced caliber bore received in and detachably mounted to the original revolver barrel, and
   (b) a cylinder insert removably received in the cylinder chamber between the substitute barrel and the powder-receiving compartment, the insert having a caliber bore substantially the caliber of the substitute barrel.

2. A caliber-reducing adaptor kit for a revolver as defined in claim 1, in which:
   (c) the cylinder insert includes a reduced bore portion for engaging and positioning a shot placed in the insert bore.

3. A caliber-reducing adaptor kit for a revolver as defined in claim 1, in which:
   (c) the cylinder insert includes:
      1. a plunger having a head at one end adjacent the substitute barrel, and a shank portion, the bore being provided in the plunger, and
      2. a sleeve slidably mounted on the shank portion adjacent the powder-receiving compartment.

4. A caliber-reducing adaptor kit for a revolver as defined in claim 3, in which:
   (d) the plunger includes a reduced bore portion in the shank portion adjacent the powder-receiving compartment for engaging and positioning a shot placed in the plunger bore.

5. A caliber-reducing adaptor kit for a revolver as defined in claim 3, in which:
   (d) sealing means is carried by the sleeve and engages the cylinder chamber.

6. A caliber-reducing adaptor kit for a revolver as defined in claim 1, in which:
   (c) the substitute barrel includes an end portion adjacent the cylinder, and
   (d) the cylinder insert is slidably mounted in the cylinder chamber, and includes a head at one end engageable with the end portion of the substitute barrel.

7. A caliber-reducing adaptor kit for a revolver as defined in claim 1, in which:
   (c) the barrel includes an end portion adjacent the cylinder, and
   (d) the cylinder insert includes:
      1. a plunger having a head at one end engageable with the end portion of the substitute barrel, and a shank portion, the bore being provided in the plunger, and
      2. a sleeve slidably mounted on the shank portion and engageable with the cylinder adjacent the powder-receiving compartment.

8. A caliber-reducing adaptor kit for a revolver as defined in claim 7, in which:
   (e) the cylinder insert includes:
      1. means retaining the sleeve captive on the plunger shank portion, and
      2. resilient means between the sleeve and plunger providing relative movement of the sleeve and plunger under resilient loading.

9. A caliber-reducing adaptor kit for a revolver as defined in claim 8, in which:
   (f) the resilient means is located about the plunger shank portion and between the plunger head and sleeve.

10. A caliber-reducing adaptor kit for a revolver as defined in claim 9, in which:
   (g) sealing means is carried by the sleeve and engages the cylinder chamber, and
   (h) the plunger includes a reduced bore portion in the shank portion adjacent the powder-receiving compartment for engaging and positioning a shot placed in the plunger bore.

11. A caliber-reducing adaptor kit for a revolver as defined in claim 10, in which:
   (i) the cylinder insert is slidably mounted and received in the cylinder chamber,
   (j) the barrel end portion adjacent the cylinder is substantially tapered, and
   (k) the plunger head is substantially tapered, and adapted to interfit and engage the substantially tapered barrel end portion.

12. A caliber-reducing adaptor kit for a revolver as defined in claim 1, in which:
   (c) the substitute barrel includes:
      1. an elongate tube extending internally of and spaced from the original revolver barrel, the tube having opposed threaded ends, and
      2. a tubular fitting threadedly connected to each threaded tube end, the fittings adjustably engaging and clamping the tube to opposite ends of the original revolver barrel.

13. A caliber-reducing adaptor kit for a revolver as defined in claim 12, in which:
   (d) the cylinder insert is slidably mounted and received in the cylinder chamber, the insert including a head at one end engaging the fitting adjacent the cylinder, the insert head and fitting having compatible, substantially mating surfaces.

14. A caliber-reducing adaptor kit for a revolver as defined in claim 13, in which:

(e) the cylinder insert includes a resilient means tending to urge the head outwardly of the cylinder chamber, the head being resiliently depressible inwardly of the cylinder chamber upon alignment of the head and substitute barrel, and resiliently extendable to snap into the fitting adjacent the cylinder.

* * * * *